US007798093B2

(12) United States Patent
Kautto et al.

(10) Patent No.: US 7,798,093 B2
(45) Date of Patent: Sep. 21, 2010

(54) ROD CRADLE FOR A FILM, COATING OR SEALING ROD

(75) Inventors: Ari-Pekka Kautto, Jyskä (FI); Sami Kuparinen, Jyväskylä (FI); Timo Lintula, Keuruu (FI)

(73) Assignee: Metso Paper, Inc., Helsinki (FI)

( * ) Notice: Subject to any disclaimer, the term of this patent is extended or adjusted under 35 U.S.C. 154(b) by 1126 days.

(21) Appl. No.: 10/596,665

(22) PCT Filed: Dec. 16, 2004

(86) PCT No.: PCT/FI2004/050189

§ 371 (c)(1),
(2), (4) Date: Jun. 20, 2006

(87) PCT Pub. No.: WO2005/016798

PCT Pub. Date: Jul. 7, 2005

(65) Prior Publication Data

US 2007/0144434 A1 Jun. 28, 2007

(30) Foreign Application Priority Data

Dec. 22, 2003 (FI) ..... 20035248

(51) Int. Cl.
*B05C 1/08* (2006.01)

(52) U.S. Cl. ..... 118/123; 118/126; 118/261; 118/413

(58) Field of Classification Search ..... 118/123, 118/126, 261, 413; 101/157, 169, 365, 120; 15/256.51, 256.52; 427/355, 359, 428.14; 162/281

See application file for complete search history.

(56) References Cited

U.S. PATENT DOCUMENTS

| | | | |
|---|---|---|---|
| 5,599,392 A | 2/1997 | Liang et al. | |
| 6,019,846 A | 2/2000 | Graf et al. | |
| 6,687,950 B1 * | 2/2004 | Rata et al. | 15/256.51 |

FOREIGN PATENT DOCUMENTS

| | | |
|---|---|---|
| FI | 111477 B | 7/2003 |
| FI | 20035248 | 12/2003 |
| JP | 10-511039 A | 10/1998 |
| WO | 00/58555 | 10/2000 |
| WO | 00/58555 A1 | 10/2000 |
| WO | 00/63494 A1 | 10/2000 |
| WO | 03/078077 A1 | 9/2003 |
| WO | 2005/061798 A1 | 7/2005 |

OTHER PUBLICATIONS

Search Report issued in PCT/FI2004/050189.
International Preliminary Report on Patentability issued in PCT/FI2004/050189.
Search Report issued in JP 2006-544482.
Overmolding Guide, GLS Corporation, 2004.

* cited by examiner

*Primary Examiner*—Laura Edwards
(74) *Attorney, Agent, or Firm*—Stiennon & Stiennon

(57) ABSTRACT

A cradle for a film, coating, or sealing rod has a profile (10) that includes a base part (11), a rod groove (16), and a body part (14) between them. The rod groove (16) is arranged to receive the rod (12) between lips (20, 20') edging the rod groove (16). The circumference lying against the rod (12) is formed at least partly of a slider piece (22), which is an insert-molded part of the profile (10), and which is of a material other than the material of the base part (11) and the body part (14).

10 Claims, 3 Drawing Sheets

ROD CRADLE FOR A FILM, COATING OR SEALING ROD

CROSS REFERENCES TO RELATED APPLICATIONS

This application is a U.S. national stage application of international app. No. PCT/FI2004/050189, filed Dec. 16, 2004, the disclosure of which is incorporated by reference herein, and claims priority on Finnish App. No. 20035248, filed Dec. 22, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a cradle for a film, coating, or sealing rod, in which the rod cradle has a profile that includes a base part, a rod groove, and a body part between them, and in which the rod groove is arranged to receive the rod between lips edging the rod groove, and in which the circumference lying against the rod is formed at least partly of a slider piece of a material other than the material of the base part and the body part. Rod cradles are used in surface-sizing and coating devices. Usually the profile includes at least one liquid groove formed on the bottom of the rod groove.

Usually, the rod cradle is machined, molded, or extruded from a single material. A compromise must then be made between the material requirements.

Finnish patent 111477 (WO00/63494) discloses a coating device for a paper machine, in which the coating cradle is in two parts. The two-part construction permits the rod groove to be made from a material better suited to the operation of the rod, when a flexible material of sufficient strength is used in the body and base parts. However, the solution disclosed is a complex totality. As such, the problems referred to in the patent are still relevant. The wear resistance of the rod cradle will not be satisfactory, if the material must be selected as a compromise with the requirements of the base and body parts. If the rod is installed in a very hard cradle, both the rod and the cradle are in danger of breaking.

In general, widely differing technical demands are placed on the rod cradle, such as

- good wear resistance
- easy installation of the rod
- good slip properties when dry and when lubricated with water, paste, or size
- good non-dirtying/release properties
- attenuation of vibration
- good chemical resistance in the prevailing environmental conditions Application publications DE 10045515 and WO 03/078077 disclose the creation of a separate rod-groove component. A rod bed consisting of a slot-like piece, which has, in addition to the rod groove, a water groove for water lubrication, is manufactured from a material with better wear resistance. The body part has a recess of corresponding size for this rod bed, to which the rod bed is locked mechanically. Such a solution is obviously expensive to manufacture, because the rod bed must be made in a completely separate work stage while the recess it requires is machined in its own work stage.

Wear resistance can be improved by surfacing, as is disclosed in PCT publication WO 00/58555. However, the thickness of the surfacing remains so small as to make the result unsatisfactory.

SUMMARY OF THE INVENTION

The present invention is intended to create a simpler rod-cradle construction than previously, in which the problems referred to are solved and the desired properties are achieved at least satisfactorily. According to the invention, a hard wear-resistant slider piece is insert molded in the profile of the rod cradle, and is bounded on the bottom of the rod groove by part of the circumference lying against the rod. In a second embodiment, the insertion casting includes the entire rod groove, together with the liquid channel. In a third embodiment, the slider piece is formed with the aid of the non-homogeneity of the profile. On the bottom of the rod groove, the compound at the location forming the sliding surface is densified or rarefied, thus increasing the local hardness and wear resistance.

Other embodiments and advantages of the invention are described in connection with the later examples of applications. The slider piece is generally harder than the body of the cradle, which is usually made from polyurethane. The slider piece is not made by extrusion from polyurethane, instead it can be of sintered thermoplastic or thermoset plastic, or molded from hard polyurethane by insert molding.

In the following, the invention is examined with the aid of examples, which are shown in the accompanying figures.

DESCRIPTION OF THE PREFERRED EMBODIMENTS

Figure 1:
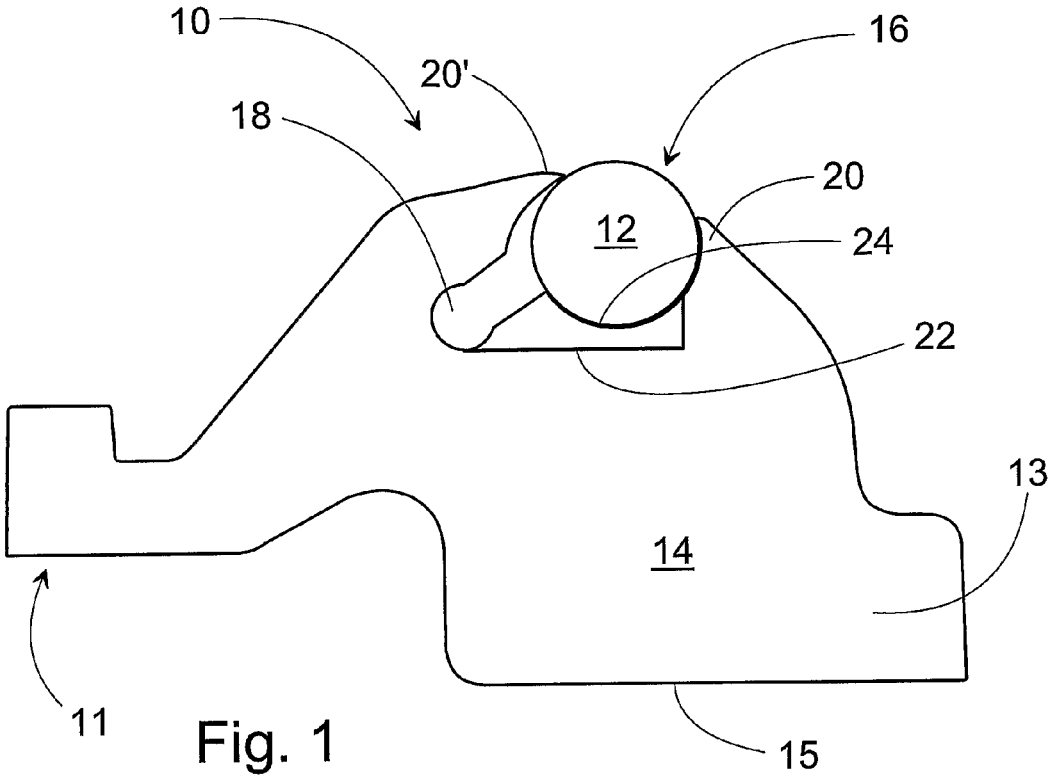
FIG. 1 shows a rod cradle equipped with an insertion-molded slider piece.

The slider cradles of FIGS. 1-5 are intended for known types of coating machines, which are used in paper and board machines. In all of the figures, the same reference numbers are used for components that are functionally similar. Thus, the reference number 10 shows the actual cradle profile while its main components are a base part 11, a body part 14, a loading surface 15, a rod groove 16 its lips 20 and 20', and a liquid groove 18.

There is a widening 13 in the cradle profile of FIG. 1, in order to widen the loading surface 15 for two loading hoses.

In terms of the present invention, the essential feature is the slider piece 22, formed on the bottom of the rod groove 16, the sliding surface 24 of which forms only a part of the sliding surface lying against the rod in the rod groove. The slider piece 22 is formed optimally in the area in which wear is otherwise greatest. The lips 20 and 20' can be formed from a flexible base material, so that there is no need to compromise in the seal. In this case, a coating rod 12 is set in the rod groove.

Figure 2:
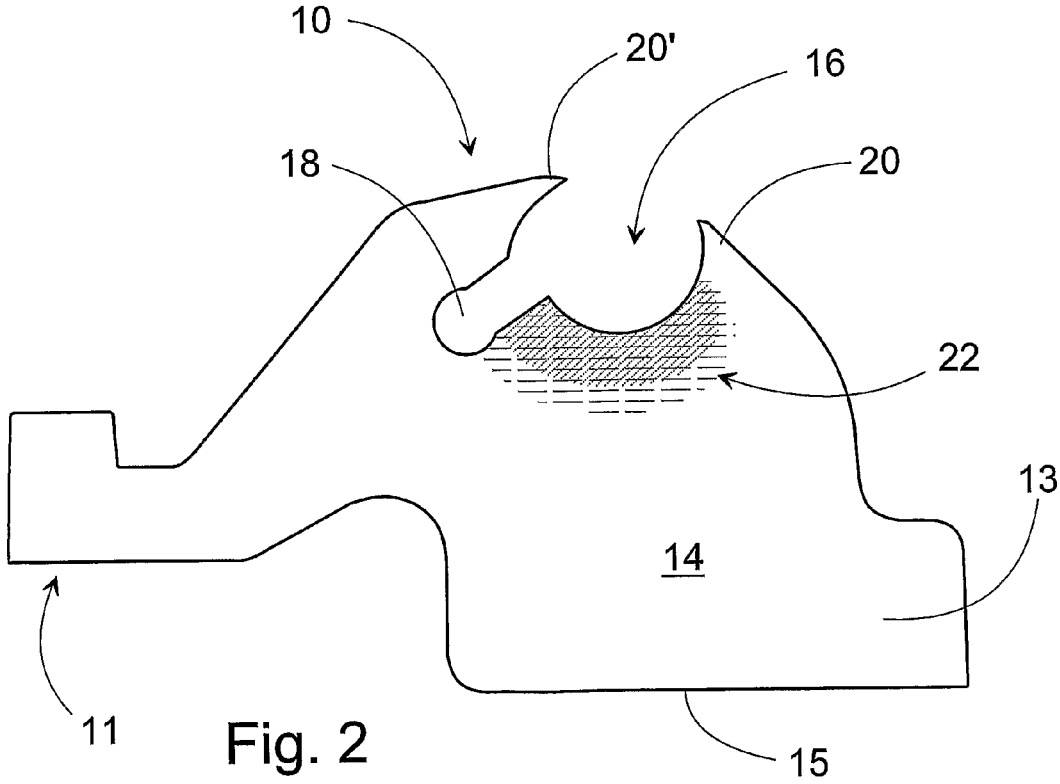
FIG. 2 shows a rod cradle equipped with a sliding surface based on non-homogeneity.

In FIG. 2, there is a variation of the rod cradle of FIG. 1. The slider piece of the profile is formed with the aid of non-homogeneity in such a way that, at the location of the slider piece of FIG. 1, there is a harder and more wear-resistant area forming through the selection of the compound material.

The manufacture of the rod cradle of FIG. 1 takes place as two consecutive moldings, in such a way that the rod cradle is molded in an up-and-down position relative to FIG. 1, so that in the first stage the slider piece 22 is molded on the bottom of the mold with the aid of an additional mold, after which the additional mold is removed, so that some other part of the profile of the rod cradle can be molded. The moldings are joined permanently to each other.

The cradle profile of FIG. 2 can be molded, for example, in such a way that the lower part of the rod cradle is molded in an inverted state relative to the figure, by filling the mold halfway, after which a bead is laid at a selected point using a polymer compound that spreads to a limited extent in semi-rigid molding, in a manner based on specific gravity, a chemical reaction, mixing, or some other spreading mechanism. The desired non-homogeneity of the profile and the desired hardness on the bottom of the rod groove can be achieved using the correct polymer and compound selection.

Figure 3A:
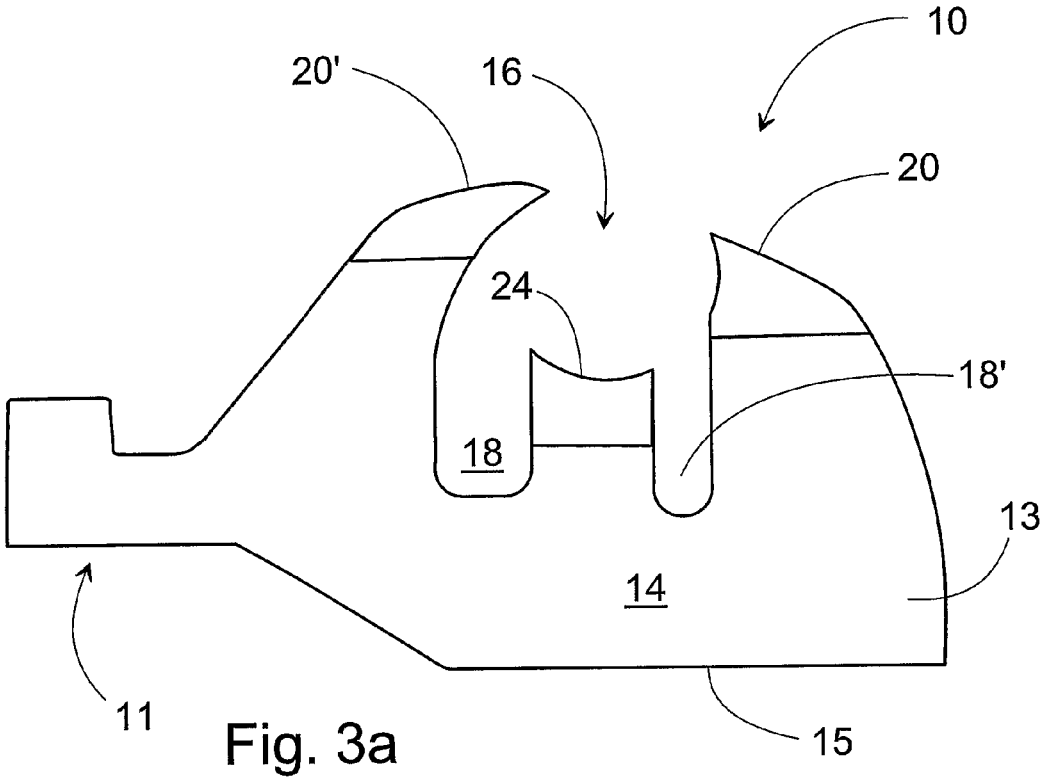
FIG. 3*a* shows a rod cradle equipped with an insertion-molded slider piece and lip pieces.

FIG. 3*a* shows an adaptation of the rod cradle of FIG. 1. In this model, there is no additional flange component, but there is a second water groove 18'. In this model, there are particularly lips 20 and 20' which are insertion-molded parts and which bound the rod groove 16. In this way, the wearing sliding surface and the sealing sliding surfaces can be formed optimally, independently of the properties of the base part and the body.

Figure 3B:
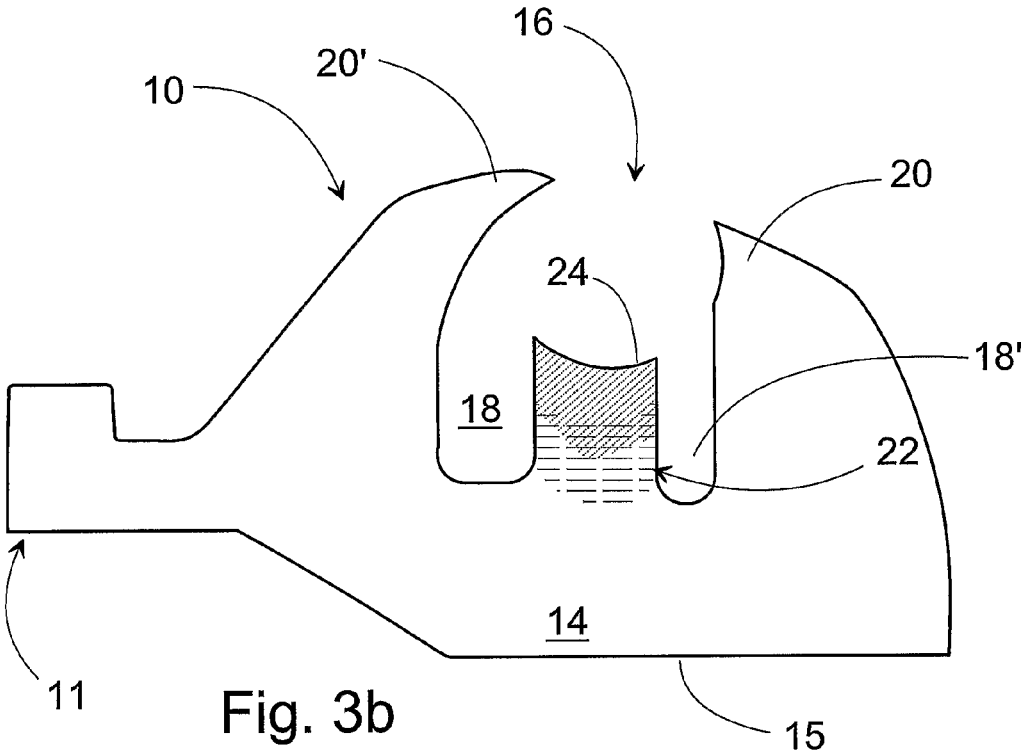
FIG. 3*b* shows an adaption of the rod cradle of FIG. 3*a*.

FIG. 3*b* shows a further adaptation of the cradle of FIG. 3*a*. The ridge between the liquid grooves 18, 18' is mixed, in order to optimize the properties of the sliding surface. In this case, the lips 20, 20' are of the base material.

Figure 4:
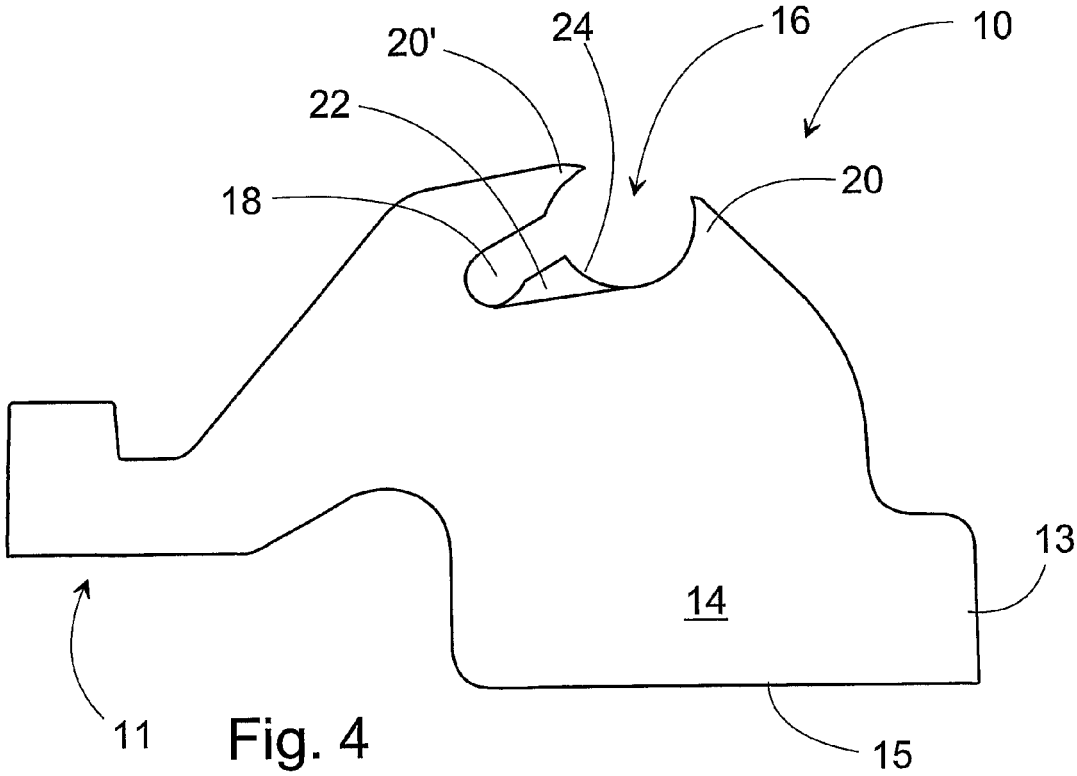
FIG. 4 shows an adaptation of the rod cradle of FIG. 1.

FIG. 4 shows an adaptation of the cradle profile of FIG. 1. In this case, the slider piece 22 is quite small, normally covering the cradle part that wears most in the rod groove 16.

Figure 5:
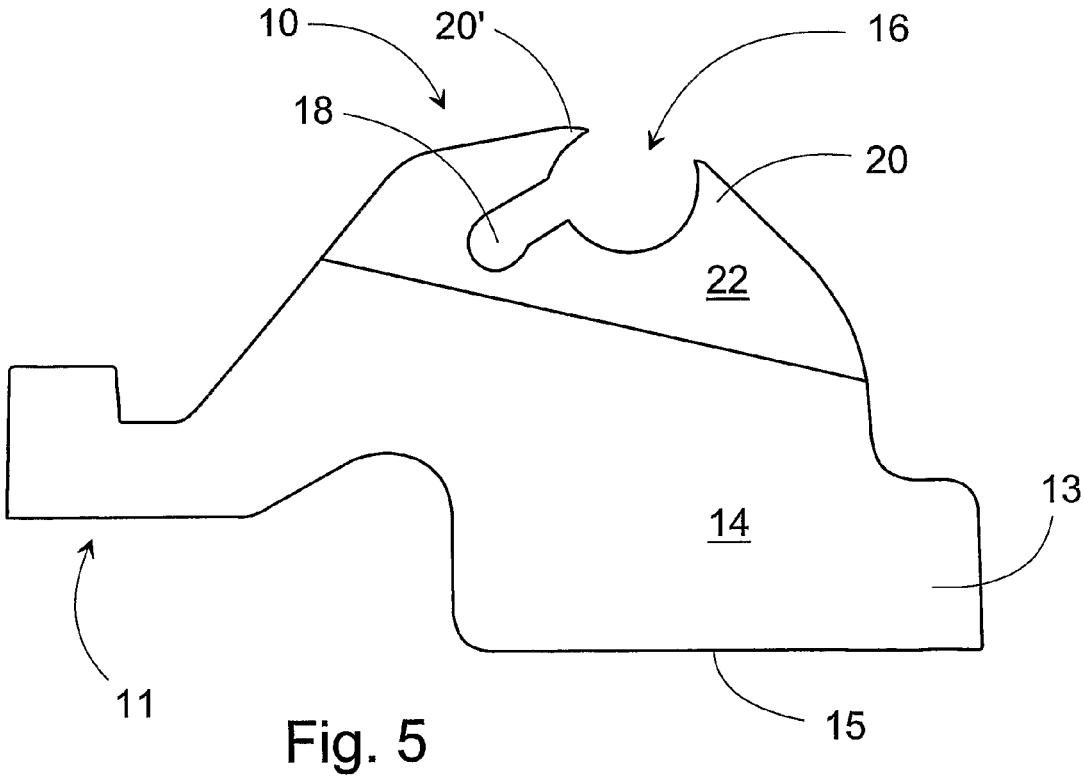
FIG. 5 shows a rod cradle equipped with an insertion-molded rod-groove part.

FIG. 5 shows an embodiment that differs completely from that described above, including an attached part 22, which includes both the rod groove 16 and the liquid groove 18 in their entirety. Though in this solution the whole sliding surface is of the same material, the solution nevertheless provides an opportunity to optimize the wearing surface, compared to the material of the base part 11 and the body part 14.

Advantages of the Invention

By manufacturing the cradle from two or more materials, the good properties of each material can be exploited.

The body of the cradle can be easily manufactured from mass-produced polyurethane, which is elastic and thus permits easy installation of the rod while also allows good sealing of the liquid groove. Polyurethane is environmentally durable and attenuates vibration.

The main sliding surface of the cradle can be manufactured from a low-friction material, such as UHMW-PE, HDPE, or fluoro-plastic.

The lips of the cradle can be manufactured alternatively from polyurethane with a good sealing property, or from low-friction hard polyurethane, by insert molding.

The invention claimed is:

1. A surface-sizing or coating device for use in paper and board machines, comprising:

a coating rod;

a rod cradle having a base part, portions of the rod cradle defining a rod groove, and a body part which is between the base part and the rod groove;

wherein the coating rod is mounted in the rod groove;

wherein the portions defining a rod groove include circumference portions edging the rod groove, the circumference portions including portions forming lips, the rod groove mounting the rod between said lips, and wherein the circumference portions are arranged to lie against the rod;

wherein the base part, the body part, and the lips are formed of a first plastic material; and wherein said circumference portions are formed partly by a slider piece of a second plastic material different than the first plastic material which is permanently joined as an insert-molded part of the cradle.

2. The rod cradle of claim 1, wherein the insert-molded slider piece forms all the circumference portions and also has portions forming a liquid groove contiguous with the rod groove.

3. The rod cradle of claim 1 wherein the slider piece is polyurethane.

4. The rod cradle of claim 1 wherein the slider piece is polyurethane filled with a substance that reduces friction.

5. The rod cradle of claim 1, wherein the slider piece has portions which engage the rod which comprise a bottom portion of the rod groove, and wherein the slider piece is non-homogenous, such that the material forming the bottom portion of the rod groove has a lower coefficient of friction than all other circumference portions.

6. An insert-molded rod cradle for a film, coating, or sealing rod for use in paper and board machines, comprising:

a first molding having portions forming a base part, portions defining a rod groove, and portions forming a body part which is between the base part and the rod groove, wherein the first molding is formed of a first plastic material;

a second molding of a second plastic material different than the first plastic material which second molding is an insert-molded part of the rod cradle, wherein the first molding and the second molding are joined permanently to each other, wherein the portions defining a rod groove include circumference portions edging the rod groove, the circumference portions including portions forming lips, the rod groove being arranged to receive a rod between said lips, and wherein the circumference portions are arranged to lie against the rod, and wherein the second molding defines a slider piece which forms at least part of the circumference portions; and wherein the slider piece of the second plastic material has portions which engage the rod which comprise a bottom portion of the rod groove, and wherein the slider piece is non-homogenous, such that the material forming the bottom portion of the rod groove has a lower coefficient of friction than all other circumference portions.

7. The rod cradle of claim 6 wherein the lips edging the rod groove are of the first plastic material.

8. The rod cradle of claim 7 wherein the slider piece is polyurethane.

9. The rod cradle of claim 6, wherein the insert-molded slider piece forms all the circumference portions and also has portions forming a liquid groove contiguous with the rod groove.

10. The rod cradle of claim 6 wherein the slider piece is polyurethane filled with a substance that reduces friction.

* * * * *